US006153980A

United States Patent [19]

Marshall et al.

[11] Patent Number: 6,153,980

[45] Date of Patent: Nov. 28, 2000

[54] LED ARRAY HAVING AN ACTIVE SHUNT ARRANGEMENT

[75] Inventors: Thomas M. Marshall, Hartsdale; Michael D. Pashley, Cortlandt Manor; Stephen Herman, Monsey; Gert W. Bruning, Sleepy Hollow, all of N.Y.

[73] Assignee: Philips Electronics North America Corporation, New York, N.Y.

[21] Appl. No.: 09/434,157

[22] Filed: Nov. 4, 1999

[51] Int. Cl.[7] ..... H05B 37/00

[52] U.S. Cl. ..... 315/200 A; 315/294; 315/306; 250/552; 250/553; 362/800

[58] Field of Search ..... 315/200 A, 164, 315/169.3, 205, 216, 294, 306, 185 R; 250/552, 553, 551, 221; 362/800

[56] References Cited

U.S. PATENT DOCUMENTS

| | | | |
|---|---|---|---|
| 4,654,629 | 3/1987 | Bezoz et al. | 315/200 A X |
| 4,864,126 | 9/1989 | Walters et al. | 250/551 |
| 5,321,593 | 6/1994 | Moates | 362/251 |
| 5,404,282 | 4/1995 | Klinke | 362/249 |
| 5,726,535 | 3/1998 | Yan | 315/185 R |
| 5,959,413 | 9/1999 | Komarek et al. | 315/306 |

FOREIGN PATENT DOCUMENTS

| | | |
|---|---|---|
| 0493015A3 | 7/1992 | European Pat. Off. . |
| WO9729320 | 8/1997 | WIPO . |

OTHER PUBLICATIONS

Japanese Abstract—"Light–Emitting Display Method", 60–91680(A).

Japanese Abstract—"LED Lighting Circuit" 4–303884(A).

Japanese Abstract "Light Emitting Diode Type Display Lamp" 56–87384(A).

*Primary Examiner*—Haissa Philogene

*Attorney, Agent, or Firm*—Robert J. Kraus

[57] ABSTRACT

A device, e.g., a luminaire, that includes a plurality of LEDs connected in series, and an active shunt arrangement for sensing a failure of one or more of the LEDs and for shunting current that would have otherwise flowed through a failed LED, to thereby maintain a flow of current through remaining ones of the plurality of LEDs. In one exemplary embodiment, the active shunt arrangement includes a plurality of active shunts connected in parallel across respective ones of the LEDs, and remote sense and digital control logic for detecting an open-circuit condition of the normally closed circuit, and for sequentially activating the active shunts until the normally closed circuit has been restored to a closed-circuit condition. In another exemplary embodiment, the active shunt arrangement includes a plurality of active shunts connected in parallel across respective ones of the LEDs, a plurality of sense circuits operatively associated with respective ones of the LEDs, each of the sense circuits being configured to sense a failure condition of its associated LED, and to produce a sense output signal upon sensing a failure condition of its associated LED, and a plurality of control circuits operatively associated with respective ones of the LEDs and respective ones of the sense circuits, each of the control circuits being responsive to the sense output signal produced by its associated sense circuit to activate the active shunt connected across its associated LED. Preferably, each of the active shunts is an active switching device, such as a power MOSFET, a bipolar transistor, or a micro-relay, that has a low on-resistance.

29 Claims, 1 Drawing Sheet

LED ARRAY HAVING AN ACTIVE SHUNT ARRANGEMENT

BACKGROUND OF THE INVENTION

The present invention relates generally to (Light Emitting Diode) LED array type light sources, and more particularly, to an LED array that includes LEDs connected in series, and having an active shunt arrangement to enable one or more failed LEDs to be bypassed, thereby averting failure of the entire LED array or an entire string of series-connected LEDs within the LED array.

LED array type light sources are currently in widespread use in a variety of different signaling and lighting applications, such as image sensors for facsimile machines and the like, and LED-based luminaires and light-engine products. From the standpoint of drive electronics, it is usually advantageous to connect all of the LEDs in series, since this results in a relatively high-voltage, low-current load, which is usually more economical to drive. For example, a 50 V/1 A load is usually more economical to drive than is a 5 V/10 A load. However, while usually advantageous from the standpoint of the drive electronics, this approach has a major drawback. More particularly, when all of the LEDs are connected in series, the failure (i.e., open circuit condition) of any one of the LEDs renders the entire LED array inoperative, i.e., a failure of any one of the series-connected LEDs results in a failure of the entire string of series-connected LEDs that includes the failed LED. For this reason, most present-day LED array type light sources incorporate a combination of series-connected and parallel-connected strings of LEDs to avoid a failure of the entire LED array upon failure of a single LED within the array. However, this solution is undesirably complex and compromises drive efficiency. Moreover, the light pattern and/or light output of the LED array is adversely affected by failure of a single LED, since an entire string of series-connected LEDs within the overall LED array is still subject to failure upon failure of a single LED within that string.

PCT Application Publication Number WO 97/29320 having an international publication date of Aug. 14, 1997, discloses a "Flight Obstacle Light" that includes an LED array that has four branches of series-connected LEDs, each of which can be located on separate circuit boards. Further, a zener diode is connected in parallel with every LED, whereby if a particular LED fails, then the current will be shunted through the associated zener diode, thus avoiding failure of the entire branch of'series-connected LEDs that includes the failed LED. Although this solution is simple, and effectively prevents failure of an entire string or branch of series-connected LEDs upon failure of a single LED within that string or branch, it suffers from a significant drawback. More particularly, the zener diodes are passive shunts which will generate (dissipate) an undesirable amount of heat while in operation.

Based on the above and foregoing, there presently exists a need in the art for an LED array that overcomes the above-described drawbacks and shortcomings of the presently available technology. The present invention fulfills this need in the art.

SUMMARY OF THE INVENTION

The present invention encompasses, in one of its aspects, a device, e.g., a luminaire, that includes a plurality of LEDs connected in series, and an active shunt arrangement for sensing a failure of one or more of the LEDs and for shunting current that would have otherwise flowed through a failed LED, to thereby maintain a flow of current through remaining ones of the plurality of LEDs.

The present invention encompasses, in another of its aspects, a device (e.g., a luminaire) that includes a plurality of LEDs connected in series, a plurality of active shunts connected in parallel across respective ones of the LEDs, a plurality of sense circuits operatively associated with respective ones of the LEDs, each of the sense circuits being configured to sense a failure condition of its associated LED, and to produce a sense output signal upon sensing a failure condition of its associated LED, and a plurality of control circuits operatively associated with respective ones of the LEDs and respective ones of the sense circuits, each of the control circuits being responsive to the sense output signal produced by its associated sense circuit to activate the active shunt connected across its associated LED. Preferably, each of the active shunts is an active switching device, such as a power MOSFET, a bipolar transistor, or a micro-relay, that has a low on-resistance.

In one disclosed exemplary embodiment, each sense circuit and its associated control circuit are implemented as an analog sense and control circuit connected in parallel across the associated LED. In another disclosed exemplary embodiment, each sense circuit is located remotely from its associated LED, each control circuit is implemented as digital control logic that produces a control signal responsive to the sense output signal produced by its associated sense circuit, with the active shunt associated with each control circuit being activated by the control signal produced by its associated control circuit.

The present invention encompasses, in yet another of its aspects, a device (e.g., a luminaire) that includes a plurality of LEDs connected in series to form a normally closed circuit, a plurality of active shunts connected in parallel across respective ones of the LEDs, and remote sense and digital control logic for detecting an open-circuit condition of the normally closed circuit, and for sequentially activating the active shunts until the normally closed circuit has been restored to a closed-circuit condition. In a disclosed exemplary embodiment, the remote sense and digital control logic is incorporated in or operatively associated with the main drive electronics of the luminaire.

Optionally, the main drive electronics can be configured in such a manner as to compensate for the reduced light output due to one or more failed LEDs by driving the remaining (still operative) LEDs proportionally harder. For example, if the total light output by a string of four series-connected LEDs is defined as 400% (i.e., 100%×4), then in order to compensate for the failure of one of these LEDs, the drive electronics must drive the three remaining LEDs approximately 33% harder in order to maintain the total light output at the same level (i.e., 133.33%×3=400%).

BRIEF DESCRIPTION OF THE DRAWINGS

These and other objects, features, and advantages of the present invention will become readily apparent from the following detailed description read in conjunction with the accompanying drawings, in which.

DETAILED DESCRIPTION OF THE INVENTION

In overview, the present invention encompasses an LED array (and any light source or light engine product incorporating the same) that includes a string of series-connected LEDs, and that further includes an active shunt arrangement to prevent failure of the entire string upon failure of a single LED in the string. In a presently preferred embodiment, the active shunt arrangement consists of an active switch (e.g., a power MOSFET, a bipolar transistor, or a micro-relay or other switching device having a low on-resistance) connected in parallel with each LED, and appropriate sense and control logic to sense a failure condition of any LED(s) in the string, and to turn on the switch(es) associated with any LED(s) that has been determined to have failed. Preferably, the shunt arrangement is designed so that if any particular LED operates normally, the active switch (shunt) associated therewith passes no current, but if that particular LED fails (i.e., presents an open circuit), then the active switch associated therewith is activated (turned on), and the string of LEDs remains operative, albeit without any light output contribution from the failed LED. Optionally, the LED array drive electronics can be configured in such a manner as to compensate for the reduced light output due to one or more failed LEDs by driving the remaining (still operative) LEDs proportionally harder. For example, if the total light output by a string of four series-connected LEDs is defined as 400% (i.e., 100%×4), then in order to compensate for the failure of one of these LEDs, the drive electronics must drive the three remaining LEDs approximately 33% harder in order to maintain the total light output at the same level (i.e., 133.33%×3=400%).

Figure 1:
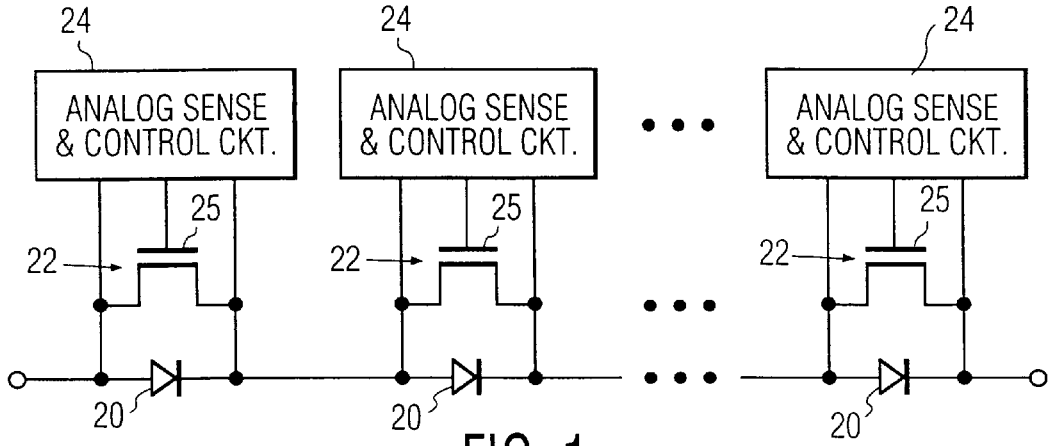
FIG. 1 is a partial schematic, partial functional block diagram depicting a first exemplary embodiment of the present invention.

With reference now to FIG. 1, there can be seen a first exemplary embodiment of the present invention, including a string of LEDs 20, a power MOSFET (Metal Oxide Semiconductor Field Effect Transistor) 22 connected in parallel with (across) each one of the LEDs 20, and an analog sense and control circuit 24 operatively coupled across each one of the LEDs 20 and to the gate electrode 25 of the power MOSFET 22 associated with that LED 20. In operation, when one of the LEDs 20 fails, the failure condition (i.e., open-circuit condition) of that LED 20 will be sensed by the analog sense and control circuit 24. In response to detecting a failed LED 20, the analog sense and control circuit 24 will generate a control signal applied to the gate electrode 25 of the power MOSFET 22 associated with that failed LED 20, in order to turn-on (activate) that power MOSFET 22, thereby shunting the current that would normally flow through the failed LED 20 through the power MOSFET 22.

It will be appreciated by those having ordinary skill in the pertinent art that any suitable active switch device can be used in place of the power MOSFET 22, which is given by way of example only. For example, a bipolar transistor, a micro-relay, or any other active switching device, preferably one with a low on-resistance (e.g., 0.0005–0.1 Ω), can be utilized in place of the power MOSFET 22. The analog sense and control circuit 24 can be implemented in any convenient manner, e.g., as a circuit comprised of one or more control transistors that are configured to sense the state of the associated LED 20 and to generate a control signal to latch the associated power MOSFET 22 on or off, as appropriate.

Figure 2:
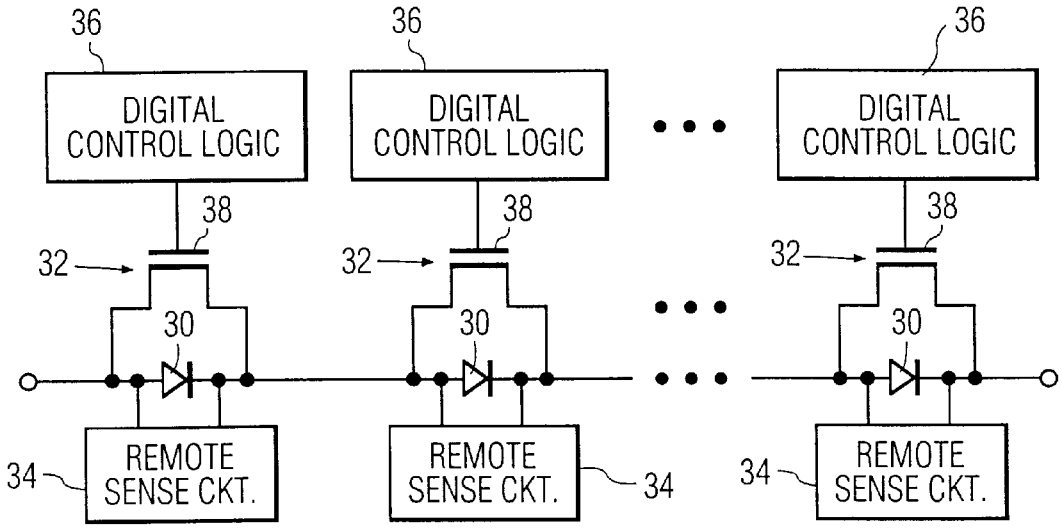
FIG. 2 is a partial schematic, partial functional block diagram depicting a second exemplary embodiment of the present invention.

With reference now to FIG. 2, there can be seen a second exemplary embodiment of the present invention, including a string of LEDs 30, a power MOSFET 32 connected in parallel with (across) each one of the LEDs 30, a remote sense circuit 34 associated with each LED 30, and digital control logic 36 associated with each LED 30. The digital control logic 36 associated with each LED 30 has an input coupled to an output of the remote sense circuit 34 associated with that LED 30 and an output coupled to the gate electrode 38 of the associated power MOSFET 32. In operation, when one of the LEDs 30 fails, the failure condition (i.e., open-circuit condition) of that LED 30 will be sensed by the remote sense circuit 34 associated with that LED 30. In response to detecting a failed LED 30, the remote sense circuit 24 will generate a sense signal applied to the input of the digital control logic 36. In response to receiving the sense signal from the remote sense circuit 34, the digital control logic 36 will generate a control signal applied, via its output, to the gate electrode 38 of the power MOSFET 32 associated with that failed LED 30, in order to turn-on (activate) that power MOSFET 32, thereby shunting the current that would normally flow through the failed LED 30 through the power MOSFET 32.

It will be appreciated by those having ordinary skill in the pertinent art that any suitable active switch device can be used in place of the power MOSFET 32, which is given by way of example only. For example, a bipolar transistor, a micro-relay, or any other active switching device, preferably one with a low on-resistance (e.g., 0.0005–0.1 Ω), can be utilized in place of the power MOSFET 32. The remote sense circuit 34 can be implemented in any convenient manner, e.g., a photodiode or photodiode array arranged to receive light produced by the associated LED 30 and to produce an output signal proportional to the amount of light received, and a signal generator responsive to the output signal to produce the sense signal in response to the output signal falling below a prescribed threshold. The digital control logic 36 can be implemented in any convenient manner, e.g., as a logic gate(s), configured to generate a control signal to latch the associated power MOSFET 32 on or off, as appropriate, in response to the sense signal. Further, it should be appreciated that the remote sense circuit 34 and digital control logic 36 associated with each LED 30 can be combined or integrated, and that they are only shown separately for purposes of ease of discussion.

Figure 3:
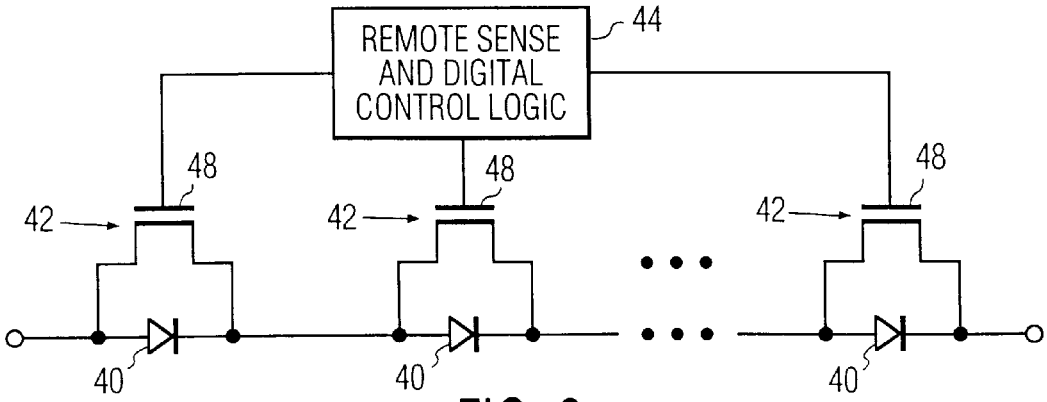
FIG. 3 is a partial schematic, partial functional block diagram depicting a third exemplary embodiment of the present invention.

With reference now to FIG. 3, there can be seen a third exemplary embodiment of the present invention, including a string of LEDs 40, a power MOSFET 42 connected in parallel with (across) each one of the LEDs 40, and remote sense and digital control logic 44. The remote sense and digital control logic 44 functions to sense the overall condition of the circuit formed by the string of series-connected LEDs 40, and in particular, whether the circuit is in an open-circuit condition (failure mode) or a closed-circuit condition (normal operating mode). The remote sense and digital control logic 44 can suitably be implemented as part of or operatively associated with the main drive electronics (not shown) of the device (e.g., LED luminaire) within which the string of LEDs 40 is incorporated, although this is, of course, not limiting to the present invention. For example, a programmable microcontroller or Programmable Logic Array (PLA) that is a part of or associated with the main drive electronics of the host device can be utilized.

In operation, when the remote sense and digital control logic 44 senses that the circuit formed by the string of series-connected LEDs 40 is in an open-circuit condition (failure mode), it sequentially activates (turns on) the power MOSFETs 42 associated with successive ones of the LEDs 40 until it senses that the circuit formed by the string of series-connected LEDs 40 is in a closed-circuit condition (normal operating mode), i.e., until the current through the circuit is restored. In other words, upon detecting a failure mode, the remote sense and digital control logic 44 generates a first control signal applied to the gate electrode 48 of the power MOSFET 42 associated with the first LED 40 in the string. If this does not restore the circuit to its normal operating mode, then the remote sense and digital control logic 44 generates a second control signal applied to the gate electrode 48 of the power MOSFET 42 associated with the second LED 40 in the string. If this does not restore the circuit to its normal operating mode, then the remote sense and digital control logic 44 generates a third control signal applied to the gate electrode 48 of the power MOSFET 42 associated with the third LED 40 in the string. This process of sequentially activating ("polling") the power MOSFETs is continued until the last power MOSFET 42 in the chain has been activated, or until the circuit has been restored to its normal operating mode, whichever occurs first. If this process of sequentially activating individual ones of the power MOSFETs 42 does not restore the circuit to its normal operating mode, then it is apparent that more than one of the LEDs 40 in the string has failed. In consideration of this possibility, the remote sense and digital control logic 44 can be designed to sequentially activate the power MOSFETs$_1$4 first singly, then in pairs, then in triplets, and so forth, until either the circuit has been restored to its normal operating mode or it is determined that every LED 40 in the string (i.e., the overall circuit) has failed.

Preferably, the remote sense and digital control logic 44 is designed to store the identity of the failed LED(s) 40, e.g., the LED 40 associated with the last power MOSFET 42 that was activated prior to restoration of the circuit to its normal operating mode. In this way, upon subsequent operation of the host device, the power MOSFET 42 associated with the previously identified failed LED 40 can be activated directly, thereby eliminating the need to repeat the sequential polling process upon each start-up of the host device. Further, if deemed desirable for a particular application, the remote sense and digital control logic 44 can be designed to test the status of individual ones of the LEDs 40 at appropriate intervals or times (e.g., upon start-up).

Additionally, the remote sense and digital control logic 44 (and/or the main drive electronics of the host device) can be configured in such a manner as to compensate for the reduced light output due to one or more failed LEDs 40 by causing the main drive electronics of the host device to drive the remaining (still operative) LEDs 40 proportionally harder. For example, if the total light output by a string of four series-connected LEDs is defined as 400% (i.e., 100%×4), then in order to compensate for the failure of one of these LEDs, the drive electronics must drive the three remaining LEDs approximately 33% harder in order to maintain the total light output at the same level (i.e., 133.33%×3=400%).

Although the present invention has been described hereinabove with respect to three exemplary embodiments thereof, it should be appreciated that many alternative embodiments, variations and/or modifications of the basic inventive concepts taught herein that may become apparent to those having ordinary skill in the pertinent art will still fall within the spirit and scope of the present invention as defined in the appended claims.

For example, in any of the exemplary embodiments discussed above, rather than a separate active shunt being connected across each LED in a string of LEDs, a single active shunt can be connected across two or more of the LEDs, whereby failure of any one or more of the LEDs associated with a single active shunt will result in the current that would have normally passed through all of the LEDs associated with that single active shunt, being instead shunted through that single active shunt. Of course, this implementation would result in a trade-off between cost savings and light output level.

What is claimed is:

1. A device, comprising:

a plurality of LEDs connected in series;

at least one active shunt connected in parallel across one or more of the LEDs;

sensing means for sensing a failure of any one or more of the LEDs that has an active shunt connected across it; and control means for activating the active shunt connected across each LED whose failure has been sensed by the sensing means.

2. The device as set forth in claim 1, wherein each active shunt comprises an active switch.

3. The device as set forth in claim 1, wherein each active shunt comprises a switching device selected from a group of switching devices that includes power MOSFETs, bipolar transistors, and micro-relays.

4. The device as set forth in claim 2, wherein each active switch has a low on-resistance.

5. The device as set forth in claim 1, wherein the sensing means comprises a photodiode sensing means.

6. The device as set forth in claim 1, wherein the sensing means comprises a separate analog sensing circuit operatively associated with each of the LEDs that has an active shunt connected across it.

7. The device as set forth in claim 1, wherein the sensing means and the control means collectively comprise a separate analog sensing and control circuit operatively associated with each of the LEDs that has an active shunt connected across it.

8. The device as set forth in claim 1, wherein the sensing means is located remotely from the LEDs.

9. The device as set forth in claim 1, wherein:

the sensing means produces a sense output upon detecting a failure of one of the LEDs; and the control means produces a control signal responsive to the sense output of the sensing means;

wherein the active shunt connected across the one of the LEDs whose failure has been sensed by the sensing means is activated in response to the control signal produced by the control means.

10. The device as set forth in claim 9, wherein the sensing means is located remotely from the LEDs.

11. The device as set forth in claim 9, wherein the control means comprises digital control logic.

12. The device as set forth in claim 10, further comprising light output compensation means for driving the LEDs that have not failed harder in order to compensate for reduced light output due to failure of the one of the LEDs whose failure has been sensed by the sensing means.

13. The device as set forth in claim 11, wherein the control means is located remotely from the LEDs.

14. The device as set forth in claim 1, wherein the device is a luminaire that includes LED drive electronics.

15. The device as set forth in claim 14, wherein the control means is incorporated into the LED drive electronics of the luminaire.

16. The device as set forth in claim 14, wherein the control means is operatively associated with the drive electronics of the luminaire.

17. The device as set forth in claim 1, wherein the sensing means detects failure of any one or more of the LEDs by detecting an open circuit condition of an overall circuit formed by the plurality of series-connected LEDs.

18. The device as set forth in claim 17, wherein the control means includes digital control logic that sequentially activates each of the active shunts until the overall circuit has been restored to a closed circuit condition.

19. The device as set forth in claim 18, wherein:

the device is a luminaire that includes LED drive electronics; and the control means is operatively associated with the LED drive electronics of the luminaire.

20. The device as set forth in claim 18, wherein:

the device is a luminaire that includes LED drive electronics; and both the sensing means and the control means are operatively associated with the LED drive electronics of the luminaire.

21. A device, comprising:

a plurality of LEDs connected in series; and an active shunt arrangement for sensing a failure of one or more of the LEDs and for shunting current that would have otherwise flowed through a failed LED, to thereby maintain a flow of current through remaining ones of the plurality of LEDs.

22. A luminaire that incorporates the device set forth in claim 21.

23. A device, comprising:

a plurality of LEDs connected in series;

a plurality of active shunts connected in parallel across respective ones of the LEDs;

a plurality of sense circuits operatively associated with respective ones of the LEDs, each of the sense circuits being configured to sense a failure condition of its associated LED, and to produce a sense output signal upon sensing a failure condition of its associated LED; and a plurality of control circuits operatively associated with respective ones of the LEDs and respective ones of the sense circuits, each of the control circuits being responsive to the sense output signal produced by its associated sense circuit to activate the active shunt connected across its associated LED.

24. The device as set forth in claim 23, wherein each sense circuit and its associated control circuit collectively comprise an analog sense and control circuit connected in parallel across the associated LED.

25. The device as set forth in claim 23, wherein each sense circuit is located remotely from its associated LED.

26. The device as set forth in claim 25, wherein:

each control circuit comprises digital control logic that produces a control signal responsive to the sense output signal produced by its associated sense circuit; and the active shunt associated with each control circuit is activated by the control signal produced by its associated control circuit.

27. A device, comprising:

a plurality of LEDs connected in series to form a normally closed circuit;

a plurality of active shunts connected in parallel across respective ones of the LEDs; and remote sense and digital control logic for detecting an open-circuit condition of the normally closed circuit, and for sequentially activating the active shunts until the normally closed circuit has been restored to a closed-circuit condition.

28. A luminaire that incorporates the device set forth in claim 23.

29. A luminaire that incorporates the device as set forth in claim 27.

* * * * *